US009808398B1

(12) United States Patent
Holtsnider et al.

(10) Patent No.: US 9,808,398 B1
(45) Date of Patent: Nov. 7, 2017

(54) SHUTTLE JET

(71) Applicant: Waterway Plastics, Oxnard, CA (US)

(72) Inventors: Mike D. Holtsnider, Moorpark, CA (US); Luis E. Fuentes, Oxnard, CA (US); Jason W. Hillyard, Fillmore, CA (US)

(73) Assignee: Waterway Plastics, Oxnard, CA (US)

( * ) Notice: Subject to any disclaimer, the term of this patent is extended or adjusted under 35 U.S.C. 154(b) by 0 days.

(21) Appl. No.: 14/692,839

(22) Filed: Apr. 22, 2015

(51) Int. Cl.
*A61H 33/04* (2006.01)
*A61H 33/00* (2006.01)
*A61H 33/02* (2006.01)

(52) U.S. Cl.
CPC ..... *A61H 33/6057* (2013.01); *A61H 33/027* (2013.01)

(58) Field of Classification Search
USPC ..... 4/541.6; 239/382
See application file for complete search history.

(56) References Cited

U.S. PATENT DOCUMENTS 5,689,896 A * 11/1997 Smetana ..... A45D 20/124 239/505
2007/0033725 A1* 2/2007 Holtsnider ..... A61H 33/027 4/541.6
2009/0193574 A1* 8/2009 Holtsnider ..... A61H 33/6063 4/541.6

* cited by examiner

*Primary Examiner* — Lauren Crane
(74) *Attorney, Agent, or Firm* — Sandy Lipkin

(57) ABSTRACT

A hydrotherapy shuttle jet apparatus that provides for the movement of a movable shuttle wherein the movable shuttle reciprocates back and forth along the center axis of the jet apparatus with the application of pressurized water flow wherein the movable shuttle has a specific shape and size as to move within a cavity in the jet that is held in place through the force of the eddy currents created by the pressurized water flow. The shuttle is able to maintain its position substantially centered on the center axis.

6 Claims, 9 Drawing Sheets

SHUTTLE JET

BACKGROUND OF THE INVENTION

Field of the Invention

The present invention relates generally to the field of massage jets and more particularly toward a massage jet employing an oscillating shuttle that creates a reciprocating effect for the purpose of providing a massage for a person positioned inside a hydrotherapy vessel.

Description of the Prior Art

Hydrotherapy vessels are often used to soothe sore muscles and joints for persons sitting thereon. The hot moving water provides a therapeutic effect. Additionally, massage jets are included in the vessel to provide pressure on specific points on the body. The massage jets utilize moving objects as well as moving water to provide this effect.

Some prior art devices such as U.S. Pat. No. 7,832,029 to Holtsnider provide a hydrotherapy jet that provides pulsating water stream around a movable shuttle housed inside the jet that causes a stream of water to pulsate as it exits the jet that can then be used to provide a massage to a person sitting in the vessel. This invention includes a tab that is required for the invention to work. Without the tab in the prior invention, the movable shuttle would wedge into an exit opening. The tab in the '029 patent keeps the shuttle free to move with the turbulence of the water without being lodged in an exit hole.

It is the object of the instant invention to provide a hydrotherapy jet similar to the '029 patent, but that does not include the tab but rather provides for a different movement of the movable shuttle wherein the movable shuttle reciprocates back and forth along the center axis to maintain its position substantially centered on the center axis whereas in the prior art patent the movable shuttle is kept away from the center axis by the tab leaving the movable shuttle to bounce around the center using turbulence in the water flow. The instant invention improves on the prior art in that no tab is required and the water moves around the shuttle differently providing an improved hydrotherapy single shuttle jet.

SUMMARY OF THE INVENTION

The preferred embodiment of the present invention teaches a system for providing massaging pressure from a hydrotherapy jet comprising: a hydrotherapy vessel with a main body of water therein; a pressurized water source for moving water through said main body of water; a jet body with a hollow cavity through which water from said pressurized water source can pass therethrough; a shuttle that rests within said hollow cavity; a retaining member that keeps said shuttle movably attached to said jet body wherein when said pressurized water source is activated said shuttle is forced away from said pressurized water source and toward said main body of water and wherein said shuttle is of sufficient size and shape to be pulled back into said cavity through eddy forces acting upon said shuttle as it moves away from said pressurized water source.

The above embodiment can be further modified by defining that said retaining member rests between said hollow cavity and said shuttle.

The above embodiment can be further modified by defining that said retaining member has one or more prongs.

The above embodiment can be further modified by defining that said retaining member is attached to said shuttle as well as to said jet body.

The above embodiment can be further modified by defining that said retaining member is a membrane.

The above embodiment can be further modified by defining that said membrane is elastic and permeable.

The above embodiment can be further modified by defining that said membrane is made of a mesh.

The above embodiment can be further modified by defining that said shuttle is spherical.

The above embodiment can be further modified by defining that said shuttle is pyramidal.

The above embodiment can be further modified by defining that said shuttle is cubical.

The above embodiment is not limited to any particular geometrical shape and can be any of a number of various shapes, including an almost infinite possibilities combining complex shapes and surface features.

An alternate embodiment teaches a system for providing massaging pressure from a hydrotherapy jet comprising: a hydrotherapy vessel with a main body of water therein; a pressurized water source for moving water through said main body of water; a jet body with a hollow cavity through which water from said pressurized water source can pass therethrough; a shuttle that rests within said hollow cavity wherein when said pressurized water source is activated said shuttle is forced away from said pressurized water source and toward said main body of water and wherein said shuttle is of sufficient size and shape to be pulled back into said cavity through eddy forces acting upon said shuttle as it moves away from said pressurized water source.

DETAILED DESCRIPTION OF A PREFERRED EMBODIMENT

Figure 1:
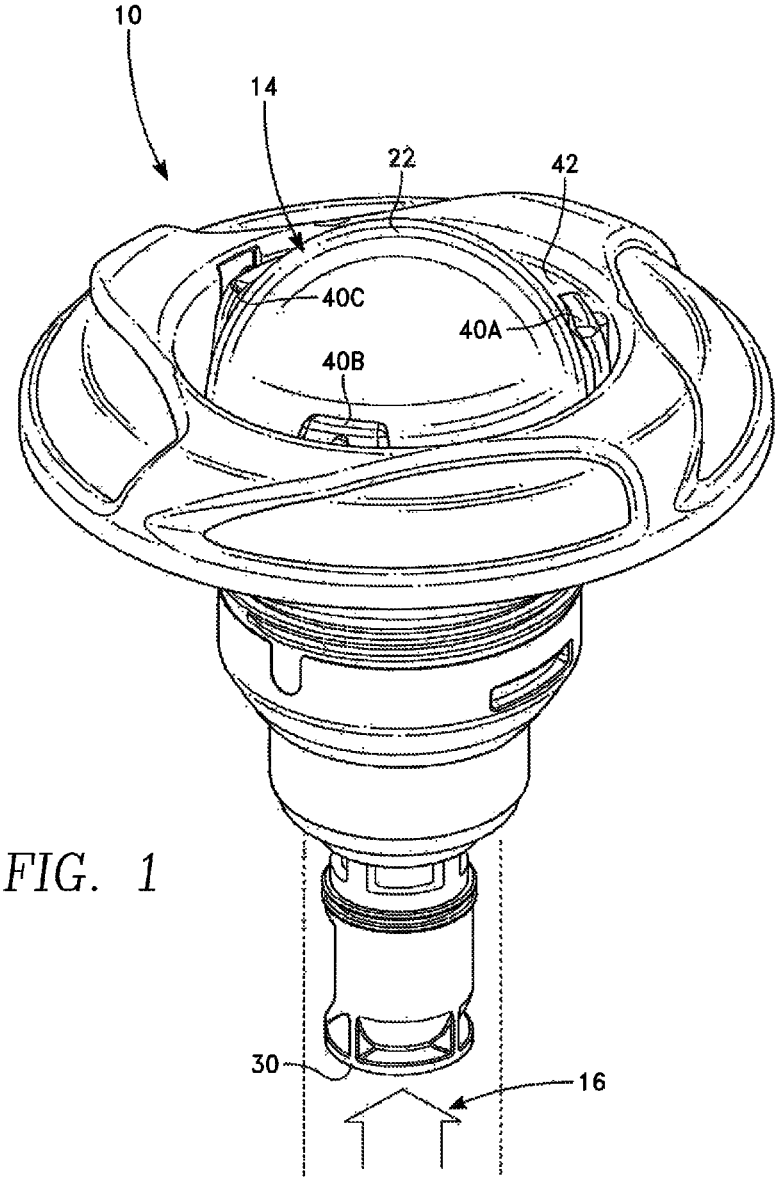
FIG. 1 is a perspective view of the shuttle jet of the instant invention.
Figure 1A:
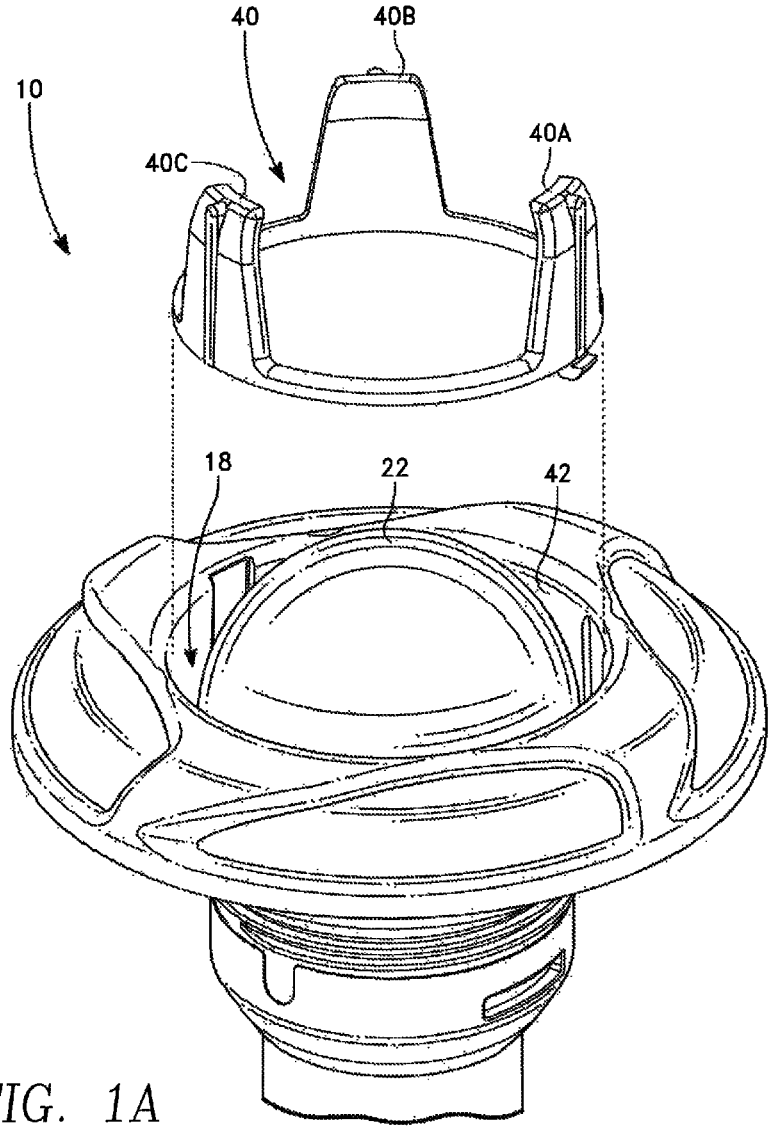
FIG. 1A is an exploded view of the shuttle jet of the instant invention.
Figure 2:
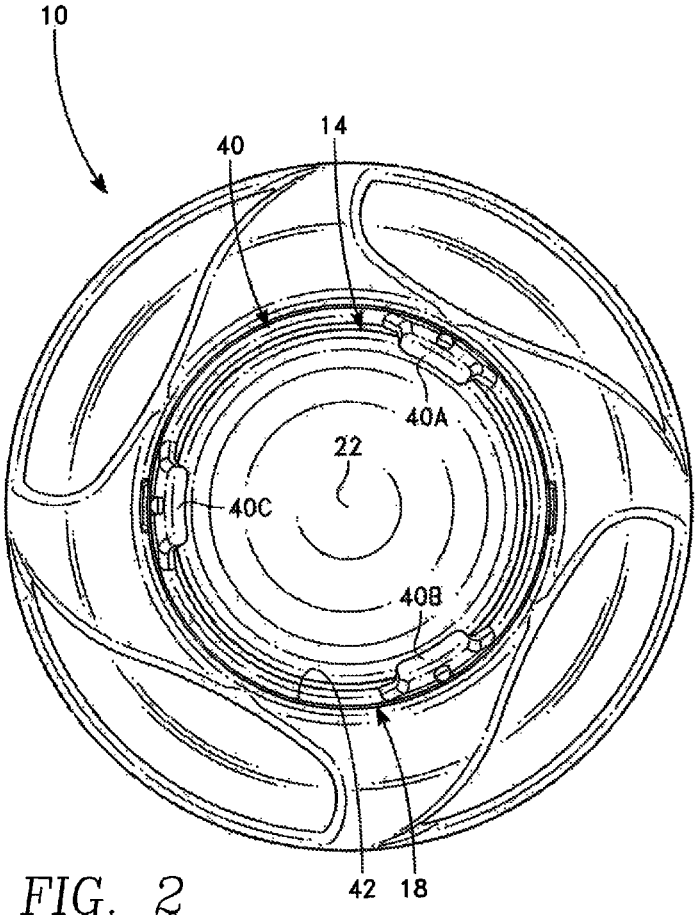
FIG. 2 is a top view of the shuttle jet of the instant invention with the shuttle inside the cavity.
Figure 3:
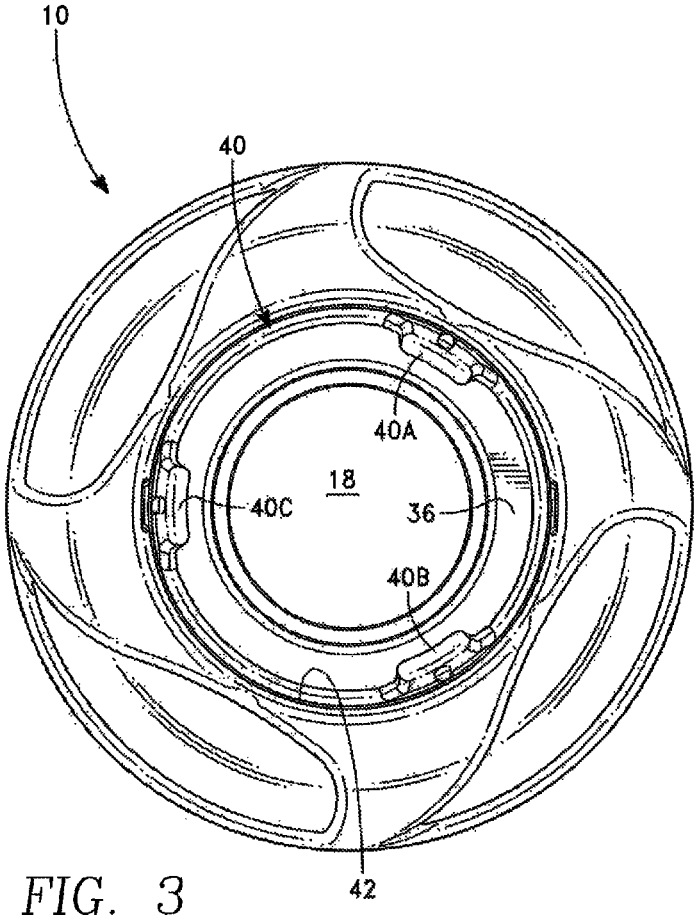
FIG. 3 is a top view of the shuttle jet of the instant invention with the shuttle not inside the cavity.

Turning to the drawings, the preferred embodiment is illustrated and described by reference characters that denote similar elements throughout the several views of the instant invention.

The preferred embodiment of the instant invention is illustrated in detail in FIGS. 1-5. The instant invention is a shuttle jet 10 that operates in a hydrotherapy vessel 12 that houses an occupant 28 and consists of a shuttle 14, a pressurized water supply 16 and a cavity 18 for housing the shuttle 14. The shuttle 14 is movably retained in the cavity 18. The shuttle 14 shape can vary, but will include a first end 20 facing the pressurized water supply 16 and a second end 22 facing the primary body of water in the hydrotherapy vessel 12.

The first end 20 facing the pressurized water supply 16 should be of sufficient size and shape as to block the effluent end 26 of the pressurized water supply 16. The second end 22 facing the primary body of water 24 in the hydrotherapy vessel 12 should be of sufficient shape as to provide a massage to an occupant 28 of the hydrotherapy vessel 12. The shuttle 14 could take the shape of a sphere, pill, or a more complex shape.

Figure 4:
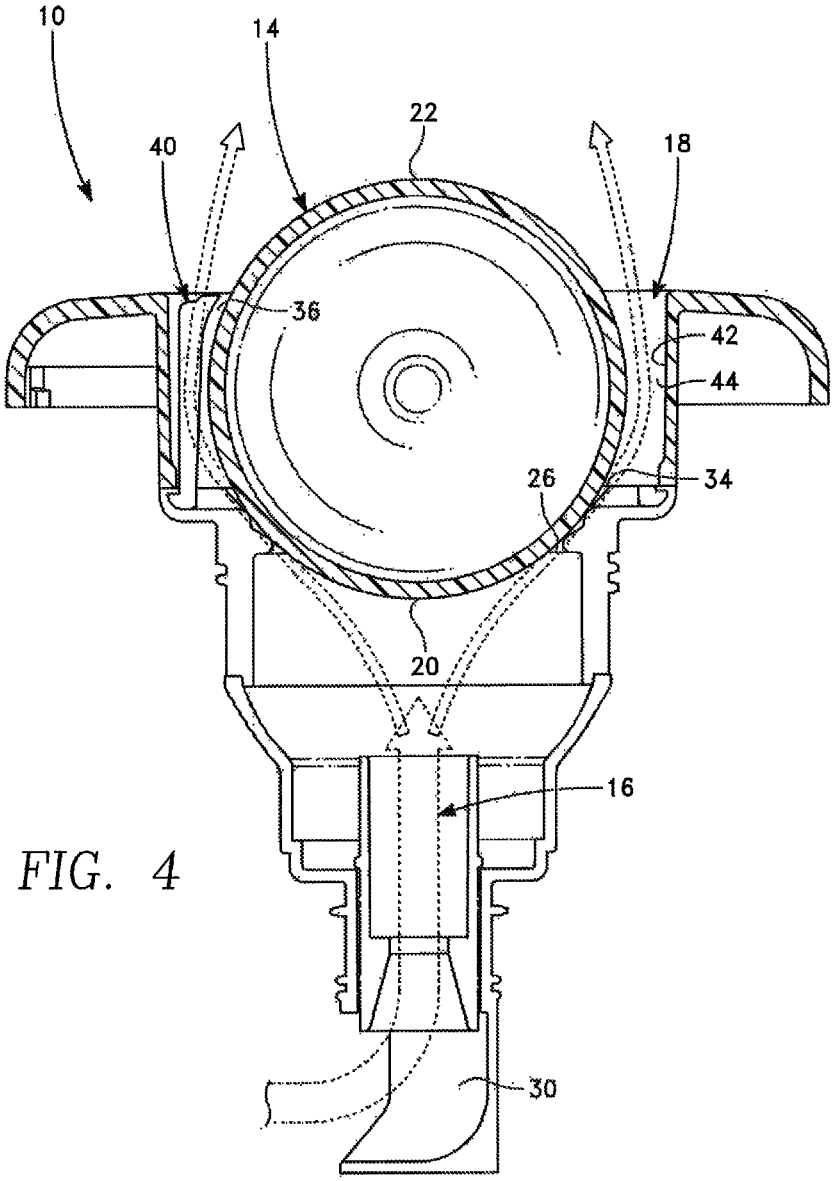
FIG. 4 is a side cross-sectional view of the shuttle jet of the instant invention.
Figure 5A:
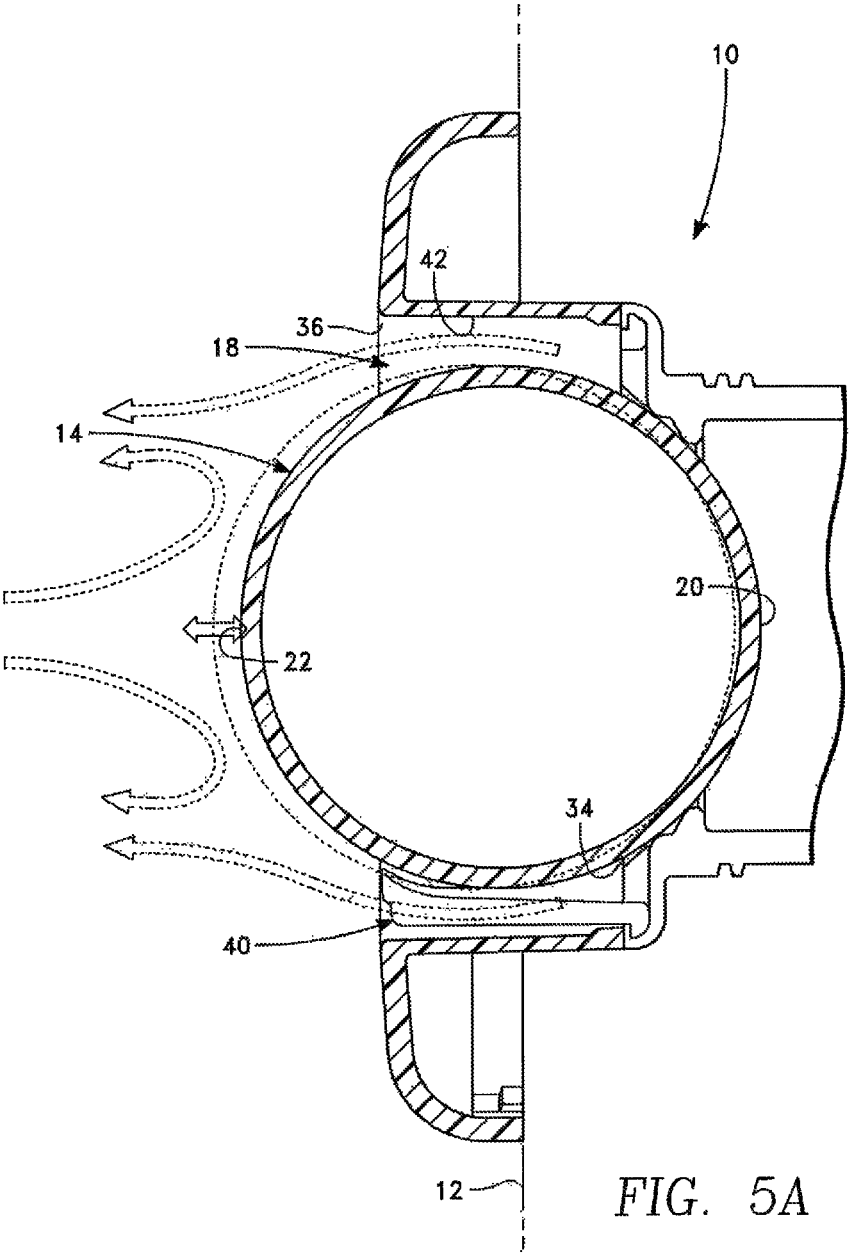
FIG. 5A is a top cross sectional view of the shuttle jet of the instant invention showing the eddy current.
Figure 5B:
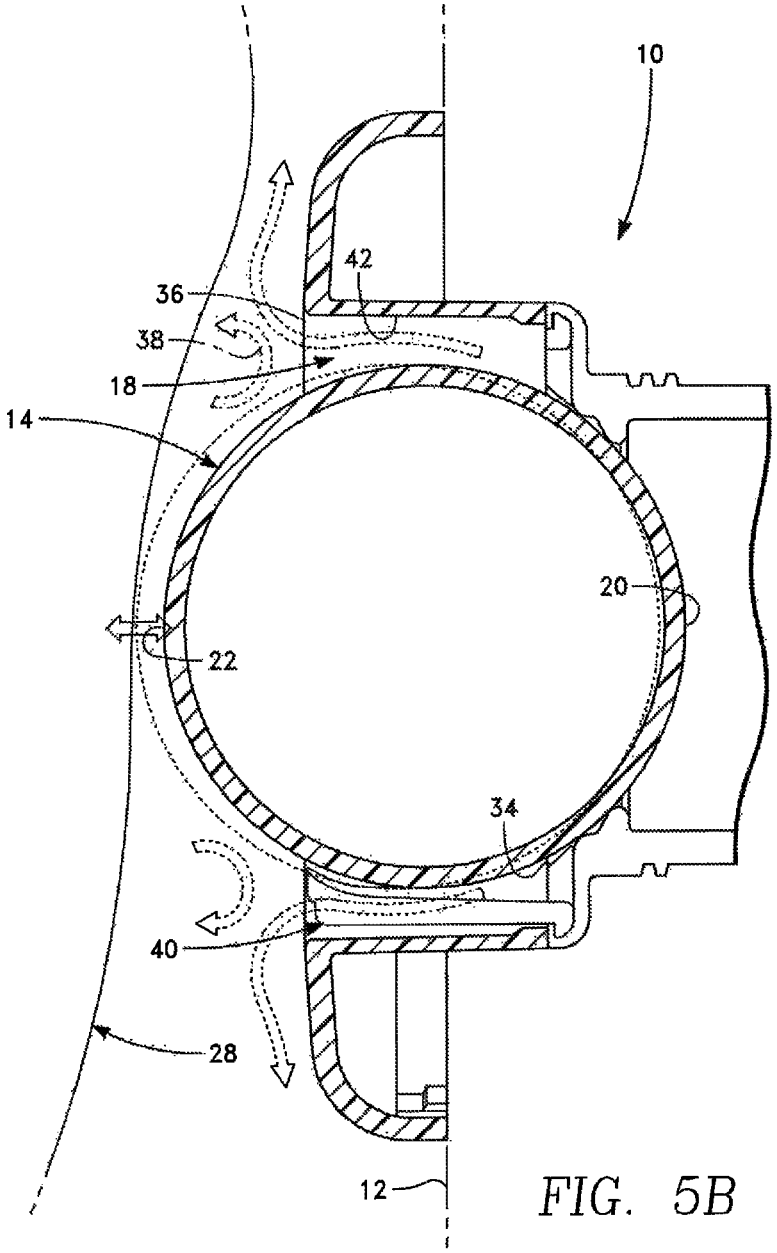
FIG. 5B is an alternate view of FIG. 5A illustrating how the shuttle is held in place.

The pressurized water supply 16 has an influent end 30 and an effluent end 26. The influent end 30 of the pressurized water supply 16 is connected to the primary body of water of the hydrotherapy vessel 12 by way of a water pump and an interconnection water conduit. The effluent end of the pressurized water supply 16 is located at the influent end 34 of the cavity 18. Water pressure and water flow are provided to the pressurized water supply 16 at the pump. The effluent end of the pressurized water supply 16 is of sufficient surface area at the location the shuttle 14 contacts as to provide adequate pressure so that the pressure provides a force that is transferred to the shuttle 14 so that the shuttle 14 may resist and overcome the pressure applied to the shuttle 14 in the opposing direction by an eddy current 38 and/or an occupant's body 28. The flow of the water and the eddy current 38 produced thereby are illustrated in FIGS. 4-5B by the dashed arrows.

The cavity 18 is connected to a pressurized water supply 16 on its influent end 34 and extends away from the influent end 34 by a side wall 42 to an opposing end 36 that is open to and fluidly connected with the primary body of water in the hydrotherapy vessel 12 at its effluent end 36.

The cavity 18 may employ a retaining feature 40, as shown with three separate prongs 40A, 40B, 40C for movably connecting the shuttle 14 to the cavity 18. The area between the shuttle 14 and the cavity 18 should be of sufficient size as to not pressurize the main flow of water within the cavity 18 as the main flow of water passes between the shuttle 14 and the cavity 18. The main flow of water in the cavity 18 should be able to pass around the shuttle 14 without forcing the shuttle 14 to stay forward toward the main body of water. The cavity 18 should be of such shape and capacity that the main flow of water 46 from the pressurized water supply 16 diverges around the shuttle 14 to flow along the side wall 42 of the cavity 18 in the direction from the influent end 34 of the cavity 18 to the effluent end 36 of the cavity 18, while allowing enough room for an eddy 38 to form within the hollow space inside of the diverged main water flow inside the main flow of water and opposing the main flow of water in the cavity 18.

Figure 6:
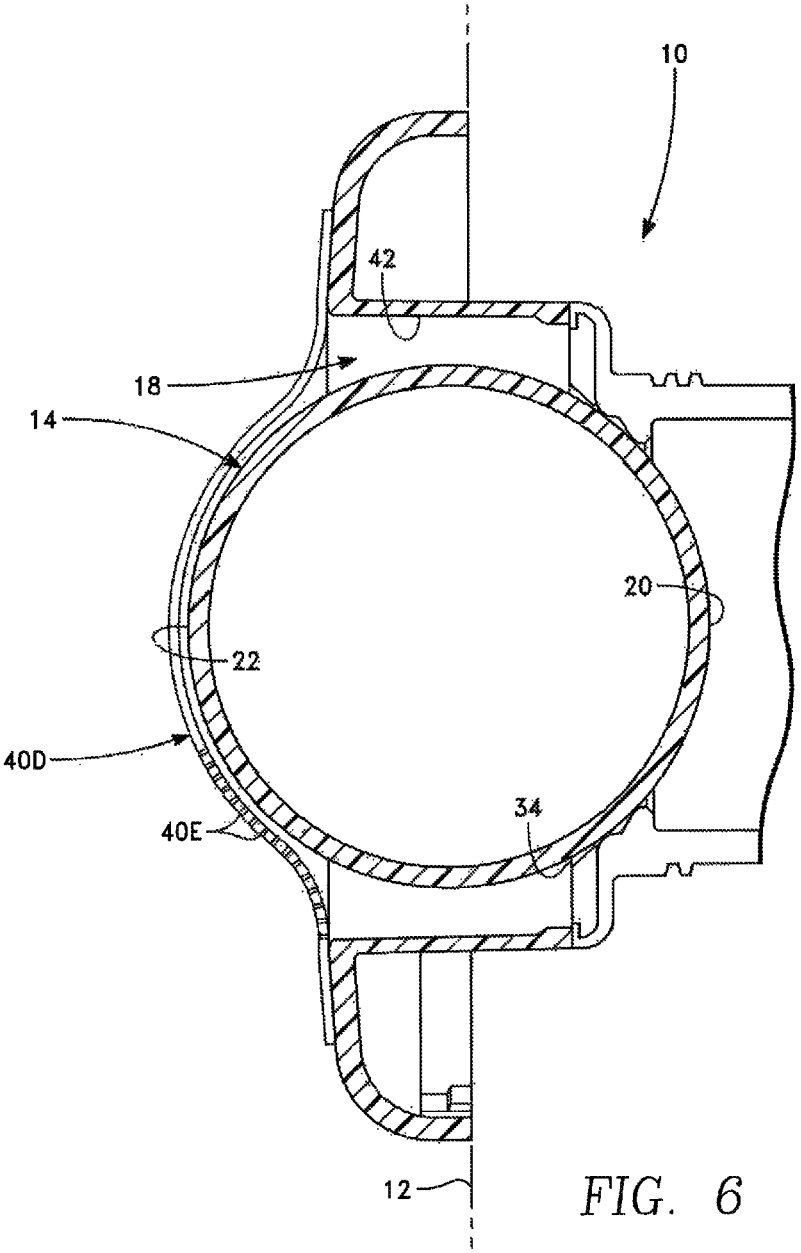
FIG. 6 is top cross-sectional view of the shuttle jet of the instant invention utilizing the membrane retaining member.
Figure 7:
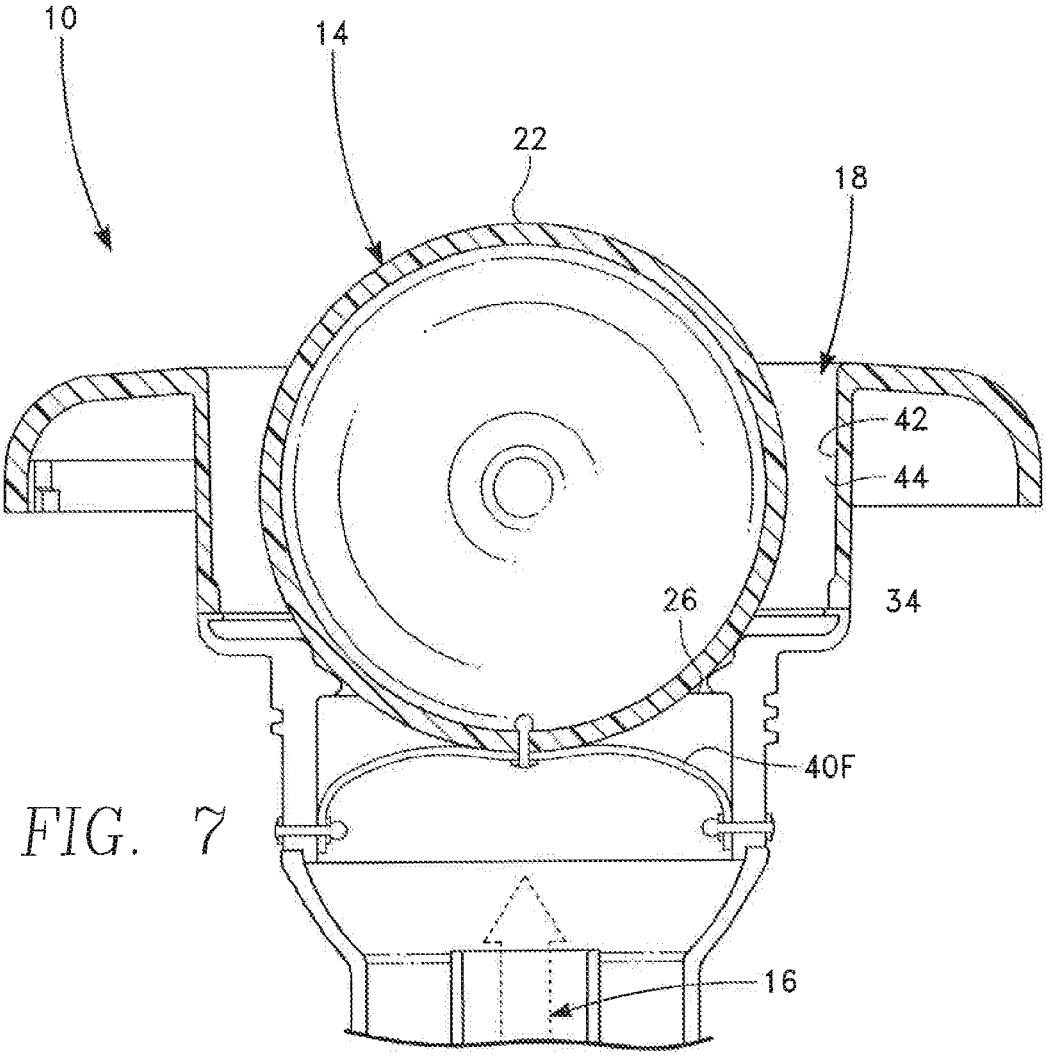
FIG. 7 is a side cross-sectional view of the shuttle jet of the instant invention showing the tether retaining means embodiment of the instant invention.
Figure 7A:
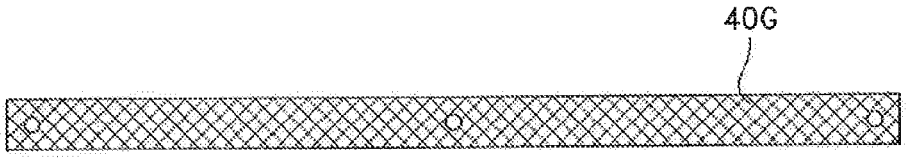
FIG. 7A is a top view of a tether to be used in the embodiment shown in FIG. 7 that is made of braided Kevlar®.

An alternate retaining means is the membrane 40D, 40E as shown in FIG. 6. The membrane 40D acts to keep the shuttle 14 inside the cavity 18 when it is under pressure and can be made with a permeable and elastic material 40D that allows the shuttle 14 to return to the pressurized end of the jet due to its elasticity. Alternatively, the membrane 40G can be made of a flexible mesh. Yet another alternative retaining means is shown in FIG. 7. In this embodiment, the shuttle 14 is attached to a tether 40F that is also attached to the jet. FIG. 7A shows a tether 40G made of a braided material.

Unstable pressure around the shuttle 14 is created between the relative distance of the shuttle 14 to the pressurized water supply 16 as well as the shuttle 14 shape as the shuttle 14 shape relates to the shape of the cavity 18. When the shuttle 14 is close to the pressurized water supply 16, the pressure of the pressurized water supply 16 forces the shuttle 14 away from the water supply. As the shuttle 14 moves away from the pressurized water supply 16, the water diverges around the shuttle 14. As the water diverges round the shuttle 14 the water creates an eddy current 38 that applies a force to the shuttle 14 that forces the shuttle 14 back toward the pressurized water supply 16. The shuttle 14 continues toward the water supply 16 until the pressure from the pressurized water supply 16 is sufficient as to stop the momentum of the shuttle 14. The pressure from the pressurized water supply 16 forces the shuttle 14 away again and the process is repeated thereby creating a reciprocating/oscillating effect along a longitudinal axis.

The design of the invention is sufficient as to avoid any possible pressure equilibrium being achieved at the location of the shuttle 14. The shuttle 14 will be forced into motion regardless of the starting position of the shuttle 14. When the pump is engaged to supply water to the pressurized water supply 16 from the primary body of water 24 of the hydrotherapy vessel 12, the shuttle 14 is forced into the reciprocating motion.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A system for providing massaging pressure from a hydrotherapy jet comprising: a hydrotherapy vessel with a main body of water therein; a pressurized water source for moving water through said main body of water; a jet body with a hollow cavity through which water from said pressurized water source can pass therethrough along a longitudinal axis; a shuttle that rests within said hollow cavity along said longitudinal axis having a bottom side oriented toward said pressurized water source along said longitudinal axis and a top side oriented away from said pressurized water source along said longitudinal axis; a retaining member that keeps said shuttle movably attached to said jet body wherein when said pressurized water source is activated said shuttle is forced away from said pressurized water source and toward said main body of water; wherein said retaining member rests between said hollow cavity and said shuttle; and wherein said shuttle is of sufficient size and shape to be pulled back into said cavity through eddy forces acting upon said shuttle as it moves away from said pressurized water source thereby creating a reciprocating pulsation of said shuttle substantially along said longitudinal axis.

2. A system for providing massaging pressure from a hydrotherapy jet comprising: a hydrotherapy vessel with a main body of water therein; a pressurized water source for moving water through said main body of water; a jet body with a hollow cavity through which water from said pressurized water source can pass therethrough along a longitudinal axis; a shuttle that rests within said hollow cavity along said longitudinal axis having a bottom side oriented toward said pressurized water source along said longitudinal axis and a top side oriented away from said pressurized water source along said longitudinal axis; a retaining member that is attached to said bottom side of said shuttle as well as to said jet body through a tether that keeps said shuttle movably attached to said jet body wherein when said pressurized water source is activated said shuttle is forced away from said pressurized water source and toward said main body of water; wherein said shuttle is of sufficient size and shape to be pulled back into said cavity through eddy forces acting upon said shuttle as it moves away from said pressurized water source thereby creating a reciprocating pulsation of said shuttle substantially along said longitudinal axis.

3. A system for providing massaging pressure from a hydrotherapy jet comprising: a hydrotherapy vessel with a main body of water therein; a pressurized water source for moving water through said main body of water; a jet body with a hollow cavity through which water from said pressurized water source can pass therethrough along a longitudinal axis; a shuttle that rests within said hollow cavity along said longitudinal axis having a bottom side oriented toward said pressurized water source along said longitudinal axis and a top side oriented away from said pressurized water source along said longitudinal axis; a membrane that keeps said shuttle movably attached to said jet body wherein when said pressurized water source is activated said membrane is breached and said shuttle is forced away from said pressurized water source and toward said main body of water; wherein said shuttle is of sufficient size and shape to be pulled back into said cavity through eddy forces acting upon said shuttle as it moves away from said pressurized water source thereby creating a reciprocating pulsation of said shuttle substantially along said longitudinal axis.

4. The system for providing massaging pressure from a hydrotherapy jet as defined in claim 3 wherein said membrane is elastic and permeable.

5. The system for providing massaging pressure from a hydrotherapy jet as defined in claim 3 wherein said membrane is made of a mesh.

6. The system for providing massaging pressure from a hydrotherapy jet as defined in claim 1 wherein said shuttle is spherical.

* * * * *